US010109400B2

(12) United States Patent
Heintz et al.

(10) Patent No.: US 10,109,400 B2
(45) Date of Patent: Oct. 23, 2018

(54) CARBON NANOTUBE THIN FILM LAMINATE RESISTIVE HEATER

(71) Applicant: Battelle Memorial Institute, Columbus, OH (US)

(72) Inventors: Amy M. Heintz, Dublin, OH (US); Katherine P. Mitchell, Pickering, OH (US); Brett R. Burton, Columbus, OH (US); Ioan I. Feier, Columbus, OH (US); Timothy J. Lastrapes, Powell, OH (US); Beth Muszynski, Columbus, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 15/263,382

(22) Filed: Sep. 13, 2016

(65) Prior Publication Data

US 2016/0379740 A1 Dec. 29, 2016

Related U.S. Application Data

(63) Continuation of application No. 13/988,037, filed as application No. PCT/US2011/061290 on Nov. 17, 2011, now Pat. No. 9,468,043.

(Continued)

(51) Int. Cl.
*H05B 3/06* (2006.01)
*H01C 17/065* (2006.01)

(Continued)

(52) U.S. Cl.
CPC ..... *H01C 17/065* (2013.01); *H01C 17/06* (2013.01); *H01C 17/281* (2013.01); *H05B 3/145* (2013.01); *H05B 3/26* (2013.01); *H05B 3/267* (2013.01); *H05B 3/565* (2013.01); *H05B 2203/013* (2013.01); *H05B 2203/017* (2013.01);

(Continued)

(58) Field of Classification Search
CPC . H05B 3/565; H05B 3/14; H05B 3/26; H05B 3/265; H05B 3/28; H05B 3/34; H05B 2203/013; H05B 2203/005; H05B 2203/007; H05B 2203/011; H05B 2203/014; H05B 2203/017; H05B 2203/032; H05B 2214/04; H01C 17/06; H01C 17/065; Y10T 29/49083; Y10T 29/49099

See application file for complete search history.

(56) References Cited

U.S. PATENT DOCUMENTS 4,952,783 A * 8/1990 Aufderheide et al. ..... 219/528
5,925,275 A 7/1999 Lawson et al.

(Continued)

FOREIGN PATENT DOCUMENTS

WO 2009/081986 * 12/2010

OTHER PUBLICATIONS

Communication from the EP Examining Division dated Apr. 28, 2016 in EP 11 808 399.7.

(Continued)

*Primary Examiner* — Shawntina Fuqua
(74) *Attorney, Agent, or Firm* — Frank Rosenberg

(57) ABSTRACT

Laminated resistive heaters comprising a carbon nanotube layer are described. The invention also includes methods of making laminated resistive heaters and applications using the resistive heaters.

15 Claims, 4 Drawing Sheets

Related U.S. Application Data

(60) Provisional application No. 61/414,894, filed on Nov. 17, 2010.

(51) Int. Cl.

| | |
|---|---|
| ***H05B 3/56*** | (2006.01) |
| ***H01C 17/06*** | (2006.01) |
| ***H05B 3/14*** | (2006.01) |
| ***H05B 3/26*** | (2006.01) |
| ***H01C 17/28*** | (2006.01) |

(52) U.S. Cl.
CPC ..... *H05B 2214/04* (2013.01); *Y10T 29/49083* (2015.01); *Y10T 29/49099* (2015.01)

(56) References Cited

U.S. PATENT DOCUMENTS

| | | | | |
|---|---|---|---|---|
| 6,054,691 | A * | 4/2000 | McGwire | 219/535 |
| 6,683,783 | B1 | 1/2004 | Smalley | |
| 7,238,196 | B2 | 7/2007 | Wibaux | |
| 7,645,400 | B2 | 1/2010 | Satoh | |
| 7,994,354 | B2 | 8/2011 | Bernecke | |
| 2005/0062024 | A1 | 5/2005 | Bessette et al. | |
| 2009/0297732 | A1 * | 12/2009 | Jiang et al. | 427/585 |
| 2009/0314765 | A1 | 12/2009 | Feng et al. | |
| 2010/0126985 | A1 * | 5/2010 | Feng et al. | 219/553 |
| 2010/0213189 | A1 | 8/2010 | Keite-Telgenbuescher | |
| 2011/0036829 | A1 | 2/2011 | Fegetsu et al. | |

OTHER PUBLICATIONS

Written Opinion of the International Searching Authority from International Application No. PCT/US2011/061290, dated May 17, 2013.

International Search Report completed by International Searching Authority dated Mar. 15, 2012 for International Application No. PCT/US2011/061290.

International Preliminary Examination issued by International Bureau dated May 21, 2013 for International Application No. PCT/US2011/061290.

Hu, L., "Percolation in Transparent and Conducting Carbon Nanotube Networks", Nano Letters, 2004,4,2513-2517.

Itkis, M.E. et al., "Purity Evaluation of As-Prepared Single Walled Carbon Nanotube Soot by Use of Solution Phase Near-IR Spectroscopy", Nano Letters, 2003, pp. 309-314, vol. 3, No. 3.

* cited by examiner

CARBON NANOTUBE THIN FILM LAMINATE RESISTIVE HEATER

RELATED APPLICATIONS

This application is a continuation of U.S. Patent Application No. 13/988,037, filed Oct. 11, 2013, now U.S. Pat. No. 9,468,043, which was a national stage filing and claims the priority benefit of Patent Application PCT/US2011/061290 and also claims priority to U.S. Provisional Patent Application Ser. No. 61/414,894 filed 17 Nov. 2010.

INTRODUCTION

Laminated resistive heaters are commercially available. For example, Thermo Heating Elements manufacture a Polymer Thick Film (PTF) heater using a polyester substrate in sheet or roll form. A polymeric, silver-based paste is first screen printed onto the polyester in the desired circuit pattern, and this sheet or roll is then oven dried to cure or "set" the element. The circuits are then die cut apart, and terminals are added for lead attachment. The open face circuit is then covered with a double-sided pressure sensitive adhesive (PSA) tape on a polyester substrate. One side of the PSA joins the top and bottom layers of the heater, while the other side of the PSA is used to apply the heater to the desired part to be heated.

Eeonyx Corporation manufactures EeonTex™ resistive heating fabric. It may be used in warming blankets; all-weather boots; and in use for de-icing of aircraft wings at high altitude.

A thermal electric heating product for anti-icing and de-icing the leading edges of aviation vehicles is known as Thermawing™. This systems comprises a graphite film which is adhesively bonded onto the surface of the wings. The installation is performed by the heater manufacturer in their facility.

The patent literature provides additional examples of resistive heaters in laminated devices. To cite one example, Lawson et al. in U.S. Pat. No. 5,925,275 describe an electrically conductive composite heating assembly. This invention relates to heater elements intended for use in applications requiring high reliability in harsh environments. The patent reports that such heaters may be suitable for ice protection systems on aerospace structures, windmill blades or other like structures Various combinations of laminated resistive heaters with a pressure sensitive adhesive are described in the patent literature. For example, Keite-telgenbuescher et al. describe in US 2010/0213189 a resistive heater comprising a pressure sensitive adhesive layer where the resistive heating layer comprises a polymer layer that may contain carbon nanotubes as a filler. The polymer layer comprises more than 50 weight % polymer. Suggested applications for the laminated resistive heater include wing deicing and wall heaters.

Bessette et al. in US 2005/0062024 describe imparting conductivity using carbon nanotubes to pressure sensitive adhesive for various applications including aerospace. The inventors describe a process for manufacturing commercial quantities of tape by compounding in a conventional mixing apparatus an admixture of a PSA composition, carbon nanotubes, any additional fillers and/or additives, and a solvent or diluent. The formulation may be coated or otherwise applied to a side of a backing layer in a conventional manner. After coating, the resultant film may be dried to remove the solvent or otherwise cured or cooled to develop an adherent film on the backing layer. As a result of the inherent tack of the PSA film, an adhesive and/or mechanical bond may be developed between layers to form the integral, laminate tape. Alternatively, the adhesive layer may be separately formed and laminated under conditions of elevated temperature and/or pressure to the backing layer in a separate operation.

Wibaux in U.S. Pat. No. 7,238,196 describe a skin-contacting heatable dressing including a pressure-sensitive adhesive layer having a first skin-contacting side and a second side; heat generating conductive carbon fibers contained within the skin-contacting pressure sensitive adhesive layer; and a source of electrical energy electrically connected to the carbon fibers. (see Abstract).

In the foregoing references, carbon nanotubes are suggested as a conductive filler in a polymer matrix to form a resistive heating layer, but those references do not suggest a carbon nanotube network layer that is substantially free of polymer. Feng et al. in US 2009/0314765 A1 describe a heater element comprising a substantially polymer-free carbon nanotube coating on a substrate. In one embodiment, a heater includes a planar support, heat-reflecting layer, a heating element, a first electrode, a second electrode, and a protecting layer.

Adhesion between layers may be a consideration during the manufacture of laminated devices. Saitoh in US 2009/0321688 described a process in which a substrate can be subjected to a corona discharge treatment prior to applying a CNT film.

Despite these efforts and other work, there remains a need for improved laminated resistive heating devices and methods for their manufacture.

SUMMARY OF THE INVENTION

In a first aspect, the invention provides a laminated resistive heater, comprising: a polymeric substrate, a CNT resistive heating layer having an interior that is substantially polymer-free disposed on the substrate, first and second electrical leads connected to the CNT layer, a protective layer disposed on a side of the CNT layer opposite the side facing the substrate, and a psa disposed on a side of the substrate opposite the side on which the CNT layer is disposed. In some preferred embodiments, the psa is directly disposed (meaning without intervening materials) on the substrate. As noted below, the description that the CNT layer is substantially polymer-free means that the interior of the CNT layer contains 5 weight % or less of polymer. The CNT layer may, and typically does, contain dopant, and may contain a dispersant-dopant such as hyaluronic acid in an amount less than 70 weight % of the CNT layer. Preferably, the substrate and/or the protective layers are transparent to a wavelength range of interest; for example, transparent to visible light.

In another aspect, the invention provides a laminated resistive heater, comprising: a polymeric substrate, a CNT resistive heating layer arranged in a plurality of separated rows disposed on the polymeric substrate, first and second electrical leads connected to the CNT layer, a protective layer disposed on a side of the CNT layer opposite the side facing the substrate. Preferably, the polymeric substrate is a grooved substrate and the CNT layer is disposed in grooves of the grooved substrate. Preferably, the protective layer directly contacts the tops of the grooved substrate.

In various preferred embodiments, the resistive heater has one or more of the characteristics mentioned herein, for example, the CNT network material having an interior that is substantially polymer-free. As another example, the resistive heater and/or any of the components of the resistive heater can have any of the properties or other characteristics mentioned in this patent specification.

The invention also includes methods of making the laminated resistive heaters. In their broadest aspects, these methods comprise arranging the components in the order described above. The methods may further include any of method steps set described in the Description section of this patent specification. In one preferred embodiment, a method comprises a first step of placing strips of a masking material over the polymeric substrate; a subsequent second step of depositing a layer of CNTs; and a third step of removing the strips of masking material to result in plurality of separated rows of CNTs disposed on the polymeric substrate.

The invention also includes methods of using the laminated resistive heaters. For example, passing a current through the CNT layer and using the laminated resistive heaters to remove ice.

In another aspect, the invention provides a method of applying a CNT network to a solid polymer substrate, comprising: a first step comprising mechanically roughening the surface of the solid polymer substrate and/or exposing the surface of the solid polymer substrate to an organic solvent; and a subsequent, second step of exposing the surface from the first step to a corona discharge, plasma, or flame; and a subsequent third step of applying a CNT dispersion to the surface resulting from the second step. Where the surface is exposed to a solvent, preferably, the organic solvent is a solvent in which the polymer substrate is partially or completely soluble. In some embodiments, this method includes other manufacturing steps to form a laminated resistive heater as described herein. The invention also includes articles made by the processes described herein.

GLOSSARY OF TERMS

Figure 1:
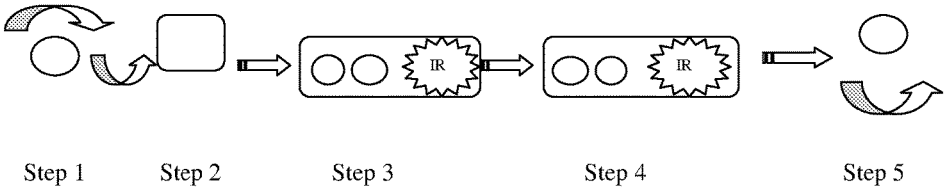
FIG. 1 is a schematic illustration of a continuous process for making a resistive heating laminate.

The term "carbon nanotube" or "CNT" includes single, double and multiwall carbon nanotubes and, unless further specified, also includes bundles and other morphologies. The invention is not limited to specific types of CNTs. The CNTs can be any combination of these materials, for example, a CNT composition may include a mixture of single and multiwall CNTs, or it may consist essentially of DWNT and/or MWNT, or it may consist essentially of SWNT, etc. CNTs have an aspect ratio (length to diameter) of at least 50, preferably at least 100, and typically more than 1000. In some embodiments, a CNT network layer is continuous over a substrate; in some other embodiments, it is formed of rows of CNT networks separated by rows of polymer (such as CNTs deposited in a grooved polymer substrate).

"Solventless" means that at least 90 mass %, preferably at least 99 mass %, more preferably 100% of the formulated coating composition remains in the dried film after cure has taken place; in the case of reactants that react to form a polymer and a low molecular weight volatile molecule, the volatile product is not included in the calculation of mass %. In some preferred embodiments, the coating formulation consists essentially of a polyurethane precursor so that at least 99 mass % of the formulated coating composition remains in the dried film after cure has taken place. In a solvent-based or water-based system, there is a higher percentage of the liquid coating which is made up of an organic solvent or water which will evaporate during the curing process.

The invention is often characterized by the term "comprising" which means "including." In narrower aspects, the term "comprising" may be replaced by the more restrictive terms "consisting essentially of" or "consisting of."

DETAILED DESCRIPTION OF THE INVENTION

The present invention relates generally to devices and methods that employ a carbon nanotube network. A laminated resistive heater according to the present invention comprises a substrate, a CNT layer disposed over the substrate, and a protective layer disposed over the CNT layer. The CNT layer is connected to electrical leads. In some preferred embodiments, the electrical leads are disposed on the substrate, and preferably are printed onto the substrate. The protective layer is typically a polymer, preferably a polyurethane, although in its broader aspects, the protective layer is not limited to a particular type of polymer. Preferably, the CNT is substantially polymer-free such that polymer (if present) does not significantly affect the electrical properties of the layer; preferably, the interior of the CNT layer contains 10 weight % polymer or less, more preferably 5 wt % or less, and still more preferably 2 wt % or less. In preferred embodiments, a pressure sensitive adhesive is present on the major side of the substrate opposite the side over which the CNT layer is disposed.

A multilayered laminate resistive heater can be manufactured with conventional roll coat equipment. The electronic leads could be printed on a base substrate, such as 3M's Aerospace quality protective film. This would eliminate the need for bulky copper leads which can interfere with the aerodynamics of the final application and increase the probability for damage because they protrude from the surface. The carbon nanotube dispersion would then be applied to the film printed with circuitry with conventional roll coating methods. The protective coating can also be applied in this manner in-line. A schematic diagram of a manufacturing process is illustrated in FIG. 1. In a first step, the substrate polymer film is unrolled and a conductive design is printed on the film. In step 3, a CNT dispersion is applied onto the film and in contact with the printed circuitry. The resulting laminated is dried, such as by passage under infrared (IR) lamps. A coating is then applied and cured (typically by heating or exposure to light) to form a protective polymeric coating. The resulting resistive heater laminate can be re-rolled for storage or transport.

This laminate can be applied in the field since the substrate is backed with a pressure sensitive adhesive (an adhesive that bonds to a substrate by the application of pressure) and a release layer. The release layer would be removed and the laminated heater applied to a substrate like a sticker. A more permanent installation of a laminate heater can be applied with a structural adhesive such as epoxy instead of a pressure sensitive adhesive.

Figure 2:
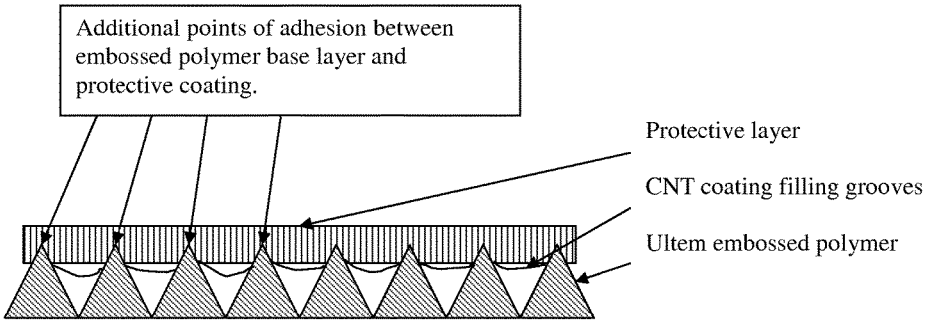
FIG. 2 is a cross-sectional, schematic view of a laminated resistive heater having rows of CNT networks in a grooved substrate, with a protective layer contacting the peaks of the grooved substrate.

A resistive heating laminate may also be comprised of a carbon nanotube dispersion applied to a grooved polymer film. The polymer substrate film is preferably a polyether imide (available from 3M under the tradename Ultem®) or other high temperature resistant thermoplastic or thermoset polymer. The polymer film would preferably have a dielectric strength of at least 300 volts per mil (0.025 mm) thickness to ensure electrical short circuits do not occur between a powered laminate heater and the object it is applied. One advantage of applying the carbon nanotube dispersion onto a surface with an embossed geometry is that a protective layer (polymer, resin or paint) will have additional points of contact at the peaks of the polymer base film and thereby improve durability and adhesion. If the carbon nanotube network is not dispersed in a polymer network, the cohesive strength of the resulting CNT coating is very low because the CNTs are held together only by Van der Waals forces. Paints, resins or other polymers which may be used to protect the nanotube network from water or other contaminants, may easily peel off the CNT layer because of the poor internal strength. By incorporating additional points of contact between the protective top layer and the base polymer layer, the laminate will have greatly improved durability from mechanical delamination from abrasive contacts such as rock strikes, cuts or other hazards. The grooves in the embossed polymer provide CNT continuity between the electrical leads. A cross-sectional schematic view is shown in FIG. 2.

The low viscosity of the CNT dispersions allow the CNT dispersion to settle into the grooves and when the residual solvent evaporates, the peaks of the grooves will be bare polymer. The peaks can also be wiped clean with a squeegee or other similar device to remove residual CNT dispersion from the peak surface of the embossed polymer. A bare polymer peak is important to ensure good adhesion to the protective top layer. The grooved polymer substrate preferably has a saw tooth, wave, or square wave pattern. In some embodiments, groove depth is 25 micrometers (μm) or more, preferably 45 μm or more; and in some embodiments in the range of 25 μm to 2 mm, more preferably 25 μm to 0.5 mm. Continuous CNT networks (preferably substantially polymer-free) are disposed in the grooves and are connected to electrical leads. Preferably, the leads are in lines that are perpendicular to groove length. In some embodiments, the electrical leads are disposed in channels that are perpendicular to groove length and/or are present as caps at the ends of the grooves. As with any of the other embodiments, a psa can, optionally, be disposed on the opposing side of the grooved support.

The height and geometry of the embossed pattern can provide a self-limiting groove to ensure uniformity of the CNT coating and uniform heating performance. The CNT coating performance is dictated by thickness of the CNT coating layer. If a lower resistance is desired, then a thicker CNT coating is applied by using a polymer with deeper embossed grooves. This thickness uniformity can be difficult to control using standard coating application methods such as spray application.

Figure 3:
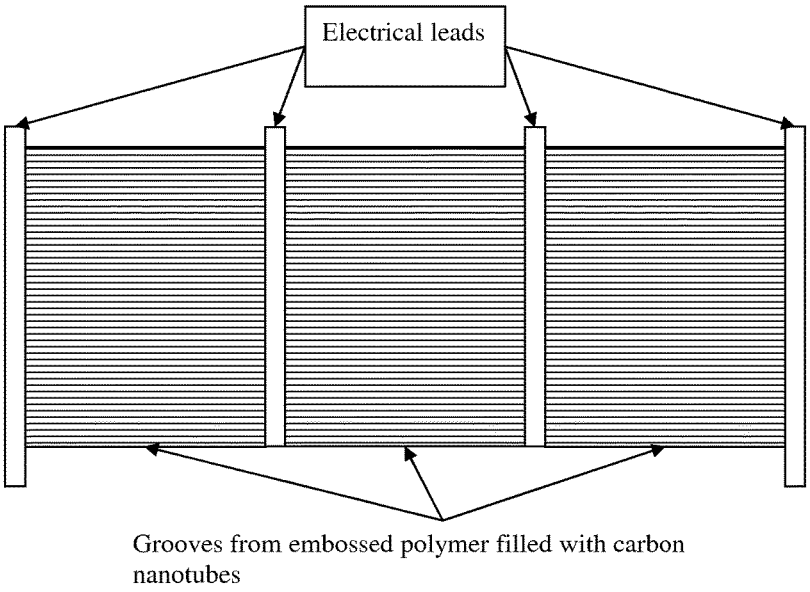
FIG. 3 is a schematic, overhead view of a grooved substrate filled with rows of CNTs and electrical contacts arranged perpendicular to the rows of CNTs.

Electrical leads can be applied by creating flat areas perpendicular to the embossed areas and laying or forming the electrical leads in the flat areas. Electrical leads can be provided before or after applying the CNTs. The electrical leads can be applied either directly onto the embossed polymer (then the CNT coating would be applied into the grooves) or the electrical leads can be applied after the CNT coating has been applied. A top-down schematic view of electrical leads perpendicular to CNT-filled grooves is shown in FIG. 3.

The aqueous or non-aqueous solvent present in common aerospace top coats, when applied to a CNT material, may disrupt the electrical properties of the CNT material by several mechanisms. One mechanism is by increasing the electrical resistance between adjacent CNTs. Topcoats dissolved in solvents can infiltrate the CNTs, permitting the topcoat resin system to permeate and cure between the individual CNT fibers. The CNTs require intimate contact to transport electrical charge from one CNT to another; charge transport takes place though either tunneling or hopping. If a non-conductive polymer resin remains between the CNTs, it prevents close contact of CNTs, which increases the energy associated with electron hopping or tunneling, and behaves as a high resistance resistor in series. The effect is that the bulk conductivity of the CNT material is reduced significantly. Treatment of CNTs with surfactants or dispersing agents is often used to improve their interaction with water or solvents. After film formation; these surfactants and dispersing agents often remain in the film, continuing to modify the surface properties of the CNTs. This renders the CNT layer more susceptible to penetration by aqueous or non-aqueous solvents.

Surfactants could include typical anionic, cationic, and non-ionic surfactants known in the art to stabilize CNTs. Dispersing agents could include molecules and polymers that stabilize CNTs by steric stabilization, such as alkylamines, or by non-covalent modification, such as pyrenes and naphthalene sulfonic acids.

Another mechanism is related to the effect of solvents on the electronic properties of the CNTs. The electrical properties of CNTs are very sensitive to environment. One common way to prepare CNT materials is to employ acid oxidation methods to improve their dispersibility in water and solvents. After deposition and drying, these CNTs remain p-doped. The electrical resistance of such films is susceptible to electron donating solvents such as those typically used in commercial aerospace topcoat coatings. Electron donating solvents include common solvents such as water, diethyl ether, tetrahydrofuran, dimethylformamide, N-methylpyrrolidinone, ethanol, methanol, isopropanol. Other common ways to prepare CNT materials include the use of dispersing agents. These systems are generally undoped systems, or un-intentionally p-doped by adventitious dopants such as oxygen. The resistance of these systems also increases upon exposure to water and other electron-donating solvents. Finally, CNT materials are sometimes formulated with a second material that behaves as an intentional p-dopant. Treatment with water or solvents can remove or dilute the effect of the p-dopant on the CNT material; thereby increasing its resistance.

Water-based coatings change the electrical properties of CNT networks, due to the fact that water is an n-dopant for CNTs, it tends to compensate dope the p-doped CNTs, which increases its resistance. As more environmentally friendly water-based coating systems are being developed for many applications, including aerospace, this threat to CNT materials must also be addressed.

A solvent-free protective layer can be used to prevent the change in resistance that accompanies the application of either organic-solvent-based or water-based coatings to CNT materials. In some preferred embodiments, the invention includes a method of making a layered CNT-containing composition, comprising: providing a CNT layer that is disposed on a substrate; and applying a solventless polymer precursor directly onto the CNT layer.

In some embodiments, the invention may include one or more of the following: curing the polymer precursor to form a polymer layer in contact with the CNT layer; the resistivity of CNT layer changes by 81% or less after coating; more preferably less than 10% before and after coating; solventless precursor comprises a diisocyanate and a diol; any of the compositions, conditions and measurable properties discussed in the Description of the Invention.

The invention also includes a layered material made by any of the methods described herein. A polymer coating prepared from a solventless method can be identified either by knowledge of the synthetic method, or by physical characterization of the polymer layer—for example, electron microscopic methods to identify surface morphology and cross-sectional morphology associated with polymer cured under solventless conditions.

In some preferred embodiments, the invention includes a layered CNT-containing article, comprising: a substrate; a conductive CNT network layer disposed between the substrate and a polyurethane coating. Preferably, the polyurethane coating is in direct contact with the CNT layer.

The inventive articles and methods may include one or more of the following characteristics, and the invention should be understood as possessing one or any combination of the properties described herein. In some preferred embodiments, the CNT layer has a sheet resistance of 120 Ω/square or less, more preferably a sheet resistance of 25 Ω/square or less, and still more preferably a sheet resistance of 1 Ω/square or less. Typically, the CNT network layer is p-doped. In some embodiments, the CNT network layer does not contain residual dispersing agent or surfactant (such as might be left behind in a dispersed CNT network layer made from non-p-doped CNTs). In some preferred embodiments, the combined CNT network layer and polyurethane coating consist essentially of CNTs and polyurethane (in other words, there are no additional components present that would decrease resistance or reduce stability of the coated CNT layer). In some preferred embodiments, the polyurethane does not contain polyether moieties. In some preferred embodiments the polyurethane does not contain any sulfate groups; preferably, the polyurethane is nonionic. In some preferred embodiments, the polyurethane is made from a polyol that is derived from vegetable oil (this can be observed spectroscopically from the ester groups in the polyurethane); in some preferred embodiments, the polyurethane is derived from an azelaic ($C_9$) ester polyol (see WO/2007/027223); in some preferred embodiments, the polyurethane comprises an azelaic ($C_9$) ester moiety. Preferably the article possesses the ability to function as a resistive heater to temperature up to 400° C., in some embodiments, in the range of 40 to 180° C., by application of a voltage in the range of 5 to 240 V. Preferably, the underlying CNT layer maintains shielding effectiveness greater than 20 dB and more preferably greater than 40 dB. In some preferred embodiments, the substrate is an airplane or part of an airplane such as a wing. The geometric surface area (that is, the area that can be measured by a ruler rather than BET surface area) of the coated article is preferably at least 0.5 cm×0.5 cm, more preferably at least 1 cm×1 cm.

The polymer coating provides sufficient chemical resistance so as to prevent solvents (including water), or other environmental hazards from subsequently applied coatings or solvents from penetrating the polymer and disrupting the CNT network or changing its conductivity significantly.

The invention also includes methods of preventing ice formation or removing ice from surfaces (such as wing surfaces) by resistive heating of a layer made according to the invention.

The invention may be further defined by any of the properties identified by the measurements described in the Examples; for example, electrical resistance, adhesion, or de-icing under conditions specified in the Examples.

Prior to coating with a polymer or polymer precursor composition (to form the protective coating), a CNT network layer is preferably in the form of a CNT/air composite, for example a CNT network film, a paper or cloth-like layer of CNTs, or a macroscopic fiber of CNTs. CNT network layers of the present invention preferably contain at least 25 weight % CNT, in some embodiments at least 50 wt %, and in some embodiments 25 to 100 wt % CNT. The CNTs can be distinguished from other carbonaceous impurities using methods known to those skilled in the art, including NIR spectroscopy ("Purity Evaluation of As-Prepared Single-Walled Carbon Nanotube Soot by Use of Solution-Phase Near-IR Spectroscopy," M. E. Itkis, D. E. Perea, S. Niyogi, S. M. Rickard, M. A. Hamon, H. Hu, B. Zhao, and R. C. Haddon, Nano Lett. 2003, 3(3), 309) Raman, thermogravimetric analysis, or electron microscopy (Measurement Issues in Single Wall Carbon Nanotubes. NIST Special Publication 960-19). The CNT network layer (again, prior to coating) preferably has little or no polymer ("polymer" does not include CNTs or carbonaceous materials that typically accompany CNTs—typical examples of polymers include polyurethane, polycarbonate, polyethylene, etc.); preferably the network layer comprises less than 5 wt % polymer, more preferably less than 1 wt %) The volume fraction in the network layer is preferably at least 2% CNTs, more preferably at least 5%, and in some embodiments 2 to about 90%. The remainder of the composite may comprise air (by volume) and/or other materials such as residual surfactant, carbonaceous materials, or dispersing agent (by weight and/or volume). "Substantially without polymer" means 5 weight % or less of polymer in the interior of a CNT film, preferably the film has 2 weight % or less of polymer, and still more preferably 1 weight % or less of polymer in the interior of the CNT film. This is quite different from composite materials in which CNTs are dispersed in a polymer matrix.

After the CNT network layer has been coated, it retains electrical conductivity provided by contacts between CNTs; it is preferably not a dispersion of CNTs in a polymer matrix. Typically, a cross-sectional view of the composite material will show a polymer layer that contains little or preferably no CNTs and a CNT network layer that comprises CNTs (and possibly other carbonaceous materials that commonly accompany CNTs, as well as surfactants) with little or no polymer. Preferably, a CNT network layer that has an overlying polymer coating comprises 50 mass % or less of the coating polymer within the CNT layer, more preferably 25 mass % or less, and still more preferably 10 mass % or less of the coating polymer within the layer. Preferably, a CNT layer comprises at least 25 mass % CNTs and carbonaceous materials, and preferably at least 50 mass % CNTs and in some embodiments 30 to 100 mass % CNTs. CNT networks and CNT fibers have very distinct rope-like morphology as observed by high resolution SEM or TEM. See for example Hu, L.; Hecht, D. S.; and Gruner, G. Nano Lett., 4 (12), 2513-2517 for CNT networks and U.S. Pat. No. 6,683,783 for images of CNT fibers. Because the CNT layers typically contain little or no polymer, they exhibit surface roughness, if characterized by AFM, associated with the CNT diameter and bundle size, in the range of 0.5 to 50 nm. Preferably, the coating composition contacts the surface of the CNT network layer but does not fill spaces within the network layer. Penetration of a coating into the CNT layer could also be determined by crosssection of the multi-layer sample and then analysis by methods such as SEM-EDS or XPS; the CNT layer is preferably substantially free from N-groups that are associated with the topcoat.

CNT layers have many contacts between CNTs and good conductivity that is, a resistivity less than 0.05 Ω·cm, preferably less than 0.002 Ω·cm. The sheet resistance of this layer should be less than 500 Ω/square, preferably less than 200 Ω/square, more preferably less than 50 Ω/square. The CNT layer may be planar, cylindrical, or other contiguous geometry; in some preferred embodiments, the CNT layer is substantially planar (similar to a sheet of paper or a non-woven textile sheet, a few fibers may project from a planar layer). These are preferred characteristics of the CNT layer both before and after a coating is applied over the CNT layer.

A CNT network in this invention can be prepared as a dispersion of CNTs applied directly to a substrate where the solvents used in the dispersion process are evaporated off leaving a layer of CNTs that coagulate together into a continuous network. The CNT network may be prepared from dispersions and applied by coating methods known in the art, such as, but not limited to, spraying (air assisted airless, airless or air), roll-coating, gravure printing, flexography, brush applied and spin-coating. The thickness of the CNT layer is in the range from 0.005 μm to 100 μm, preferably in the range of 0.05 μm to 100 μm, more preferably in the range of 0.3 μm to 100 μm.

The CNT layer may include other optional additives such as p-dopants. P-dopants could include, but are not limited to, perfluorosulfonic acids, thionyl chloride, organic pi-acids, nitrobenzene, organometallic Lewis acids, organic Lewis acids, or Bronsted acids. Materials that function as both dispersing agents and dopants such as Nafion and hyaluronic acid may be present. These materials contain p-doping moieties, i.e. electron accepting groups, within their structure, often as pendant groups on a backbone. Generally, these additives will be present as less than 70% by weight of the CNT film, and in some embodiments as less than 50% by weight of the CNT film. Polymers and carbohydrates that function as both dispersing agents and dopants can be distinguished from other polymer materials, i.e. those functioning as only a dispersing agent or those functioning as a structural component. Because of the presence of electron accepting moieties, these materials can form a charge transfer complex with semiconducting CNTs, which p-dopes the semiconducting CNTs and raises the electrical conductivity. Thus, these dual dispersing agent/dopants can be tolerated at a higher mass percentage within the CNT layer than other types of polymer materials or surfactants.

A solventless coating composition comprises reactive components that react to form a solid coating; preferably a solventless coating composition comprises a polyol and an isocynate. The polyol component of the present invention contains both (i) functionality capable of reacting with isocyanate groups ("isocyanate-reactive") and (ii) 100% solids content (free from any organic or water solvent). The expression "isocyanate-reactive" functionality as used herein refers to the presence of functional groups that are reactive with isocyanate groups under conditions suitable for cured coating formation. Such isocyanate-reactive functionality is generally known to those skilled in the coatings are and includes, most commonly, active hydrogen-containing functionality such as hydroxyl and amino groups. Hydroxyl functionality is typically utilized as the isocyanate-reactive functionality in coatings and is essentially suitable for use in the present invention. In some embodiments, the polyol is a polyester polymer having isocyanate-reactive functionality incorporated into the polymer via appropriate monomer selection. Examples of monomers that may be utilized to synthesis the polyester polyol include carboxyl group-containing ethylenically unsaturated monomers and hydroxyl group-containing ethylenically unsaturated monomers.

In some embodiments, solventless, preferably 100% solids, (free of organic and water solvent) suitable isocyanate compound or mixture of compounds can be used as the curing agent to form the protective layer. To function as an effective crosslinking agent, the isocyanate should have at least two reactive isocyanate groups. Suitable polyisocyanate crosslinking agents may contain aliphatically, cycloaliphatically, araliphatically and/or aromatically bound isocyanate groups. Mixtures of polyisocyanates are also suitable. Polyisocyanate containing aliphatically, cycloaliphatically, araliphatically and/or aromatically bound polyisocyanate groups are also suitable. This includes, for example: hexamethylene trimethylhexamethylene diisocycante, meta-α,α,α',α'-tetramethylxylylenediisocyanate, 1-isocyanato-3,3,5-trimethyl-5-isocyanatomethyl cyclohexane (isophoronoe diisocyanate or "IPDI"), bis(4-isocyanatocyclohexyl)methane (hydrogenate MDI), toluene diisocyanate ("TDI"), hexamethylene diisocyanate ("HDI") or biuret derivatives of various diisocyanates.

The methods and articles of the invention can be accomplished using a bio-based polymer. A bio-based polymer is a polymer that contains at least 40 mass %, preferably at least 50%, still more preferably at least 80 mass % and most preferably 100 mass % of materials that were derived from bio-based feedstock such as corn, soy, castor, etc.; as opposed to petroleum based feedstock raw materials. As shown in the examples, a preferred polyol is a biobased polyol.

The methods and articles of the invention may also be accomplished with other 100% solids coatings or polymer films to protect the CNT layer from water or solvent penetration. For example, a 100% solids epoxy coating system may be applied via spray or drawdown. Another example may be to place a thin, chemically resistant polymer film, such as polyurethane thermoplastic, onto the top surface of the CNT layer followed by thermal treatment to form a seal (thermoforming). Thermoforming would provide an intimate contact with the CNT layer and provide adequate protection to maintain its integrity from solvents in a topcoat layer.

In addition to the components discussed above, other additives can also be incorporated such as cure catalysts. Cure catalysts for isocyanate are well known to those skilled in the art such as organometallic catalysts and, particularly, organotin compounds such as dibutyltin diacetate, dibutyltin dioxide, bibutyltin dilaurate and the like. Other optional ingredients such as surfactants, defoamers, thixotropic agents, anti-gassing agents, flow control agents, pigments, fillers, and other additives without added organic or water solvents may be included in the composition. In preferred embodiments, the polymer precursor composition comprises at least 90 mass %, more preferably at least 95 mass % (in some embodiments at least 98 mass %) of components that, after curing, are bonded to the polymer structure.

The thickness of the coating composition over the CNT material is preferably 2 mm or less, more preferably 150 μm or less, preferably 50 μm or less, in some embodiments, a thickness of 250 nm to 50 μm; thicker layers can experience foaming or bubbling during application that leads to pathways for a subsequent topcoat to penetrate and disrupt the conductivity of the CNT layer.

A coating composition can be applied to the CNT network by known methods; for example, bar coating or spraying. Techniques, such as troweling, that disrupt the CNT network should be avoided; although troweling might be used in the case where a grooved substrate protects the CNTs. After application of a protective coating to the CNT network, the coated substrate can be cured (in some embodiments, curing is conducted at ambient temperature). In the curing operation, the film forming materials crosslink to leave a mechanically durable and chemically resistant film.

The sheet resistance of the CNT layer before coating may be determined by standard 4-point probe methods or other known methods for determining sheet resistance. The impact of the subsequent coatings on the sheet resistance of the underlying material may be determined by one of several methods, depending on the applications of interest. Metallic leads, such as silver painted leads, may be applied under or over the CNT layer and the resistance measured. Subsequent overcoats may then be applied on top of the CNT layer and the resistance re-examined. Application of the coating of this invention should result in less than 81% change in resistance, preferably less than 10% change in resistance, and still more preferably less than 5% change in resistance, after curing the coating. Likewise, application of subsequent layers on top of this stack should not increase the resistance by more than 5%, preferably by 3% or less. Alternatively, one could measure the shielding effectiveness of a CNT film before and after application of coatings, using a method such as SAE ARP-1705. Application of the coating of this invention should result in less than 38% change in shielding effectiveness, more preferably less than 5% after curing the coating. Likewise, application of subsequent layers on top of this stack (that is, the CNT network layer and the protective coating) should not decrease the shielding effectiveness by more than 5%.

CNT films containing optional p-dopant additives will show spectroscopic evidence for the presence of these dopants, before and after treatment with the coating of this invention, as well as after subsequent application of coatings to this layer. The presence of these p-dopants can be determined from chemical analysis of the CNT layer, looking for spectroscopic signatures of the dopant compounds. Alternatively, p-doped CNTs have specific NIR absorbance and Raman scattering signatures that can be detected without knowledge of the dopant's chemical structure. For example, evidence of p-doping can be determined from NIR spectroscopy. The optical absorbance spectrum of CNTs is characterized by S22 and S11 transitions, whose positions depend upon the structure distribution of the CNTs and can be determined by a Kataura plot. These two absorption bands are associated with electron transitions between pairs of van Hove singularities in semiconducting CNTs. Depletion of filled states by an electron acceptor results in bleaching of these transitions, and evidence of p-doping by the subject coating. Alternatively, p-doping can be determined from Raman spectroscopy as described by Rao, A. M.; Bandow, S.; Richter, E.; Eklund, P. C. in Thin Solid Films 1998, 331, 141-147.

EXAMPLES

A surprising result was observed when the laminate film was prepared for CNT application. 3M recommends using a solvent (Methyl Ethyl Ketone) and an abrasive (such as sandpaper) to scuff the surface. The procedure outlined by 3M is listed below:

Preparation of the 3M Tape or Boot Surface for Painting

Light scuffing and/or solvent wiping the film surface prior to painting is recommended. The following procedure should be followed.

1. Scuff the 3M Tape or Boot surface with 3M™ Scotch-Brite™ General Purpose Pad 7447.
2. Saturate a clean cotton rag with methyl ethyl ketone (MEK) and lightly wipe the 3M Tape surface (preferred method). Ethanol may be used as an alternative solvent.
3. Wipe surface dry with a lint-free cloth before the solvent evaporates from the surface.

Although this created a more tacky film, the CNT dispersion did not wet the surface uniformly when it was applied. Several plastic primers were evaluated to help prepare the surface, but they were not successful. Corona discharge (oxidative) treating the surface, however, dramatically improved the wetability of the laminate and fewer coats of CNT dispersion were required to reach a desired resistivity reading of 200 ohms. The table below shows some of the approaches to improve the surface for CNT application and the resulting observations.

| | Approach | Result |
|---|---|---|
| | No treatment | PU film is "slip resistant" and the drawdown bar does not move smoothly across. The film is hydrophobic, so dispersion does not wet. No continuous film formed. |
| Solvent Rub | Lab wipe | No apparent change in surface properties |
| | Scotch Brite #63 Pad | Film seems to swell slightly to produce a stickier surface. No continuous film formed. |
| | Sand paper 600 grit | The surface is improved over the Scotch Brite pad, film seems stickier yet. No continuous film formed. |
| | Sand paper 400 grit | The surface is improved over the Scotch Brite pad, film seems stickier yet. No continuous film formed. |
| | Sand paper 150 grit | The surface is improved over the Scotch Brite pad, film seems stickier yet. A very thin film can be formed on the surface. At room temperature, the CNT dispersion pools in the center of the film. |
| | Sand paper 60 grit | The surface is extremely stickier. A contunuous film can be formed after multiple coat applications. At room temperature the CNT dispersion pools in the center of the film. Need to oven dry at 120 F. between coats. |
| Plastic Primers | Nine One One Prime | After application and cure of plastic primer, the CNT dispersion does not wet; result worse than untreated PU film. Sanding surface improves wetting only slightly. |

-continued

| | Approach | Result |
|---|---|---|
| | CyPox Bonding System | After application and cure of plastic primer, the CNT dispersion does not wet; result worse than untreated PU film. Sanding surface improves wetting only slightly. |
| Corona Treatment | Corona 4 times | Forms a continuous film after several very thin coats. Not as even as wet sanding, above. |
| | Wet Sand with 60 grit (as above), dry in oven, Corona 4 times | Excellent film quality. Uniform after 2 coats. The dispersion is more concentrated in the grooves created by the sand paper. Little pooling. |

Figure 4:
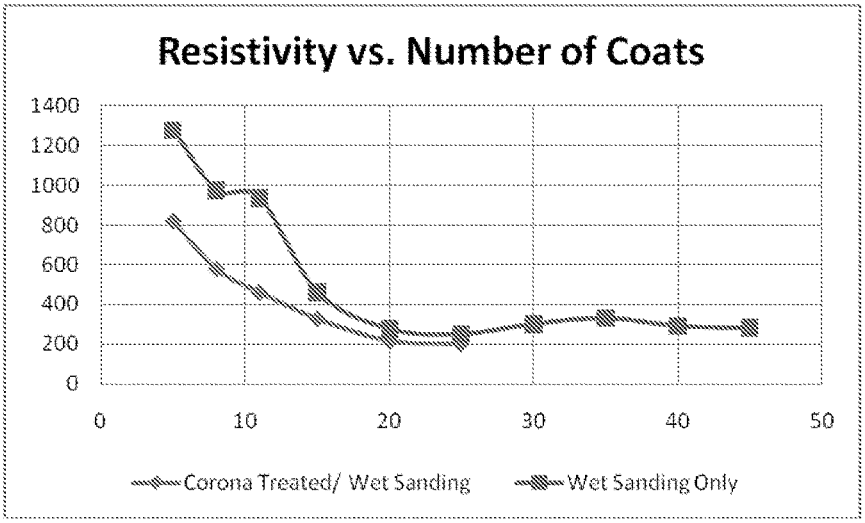
FIG. 4 is a graph showing improved resistivity that resulted from the combination of wet sanding and corona treating a polymeric substrate to enhance adhesion of a CNT network layer.

FIG. 4 shows that a wet sanded then corona treated sample reached a resistivity of 200 ohms in about 25 coats while the sample that was prepared by wet sanding only did not reach 200 ohms even after 50 coats of CNT dispersion.

We expect that other surface treatments such as plasma or gas flame treatment would also improve wetability of the CNT dispersion.

Figure 5:
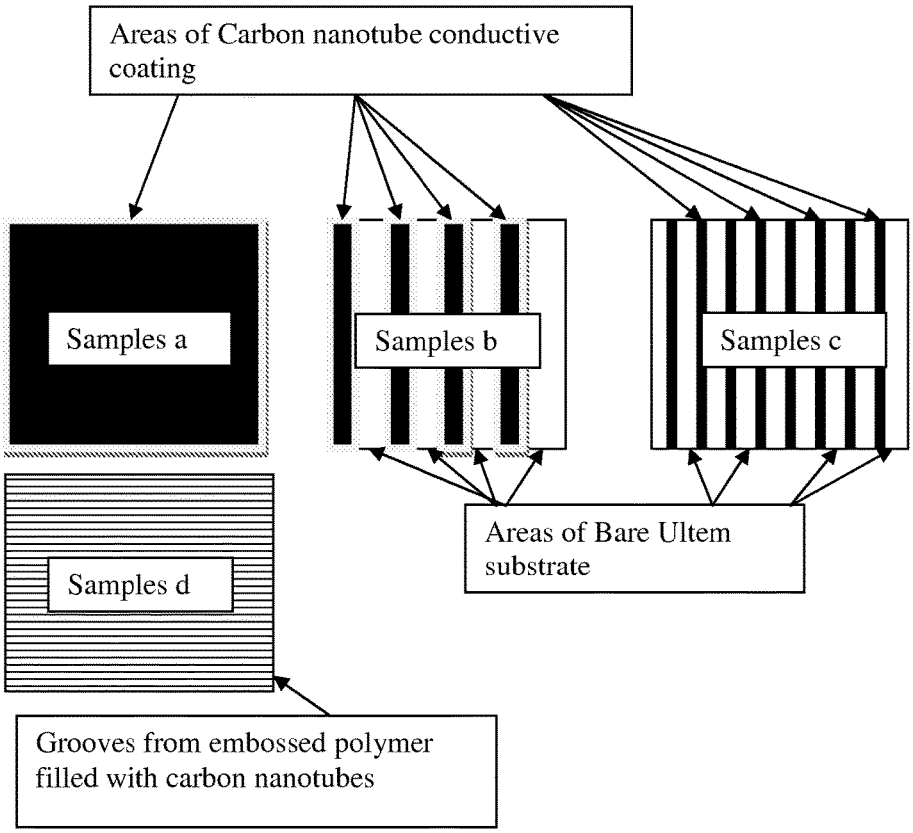
FIG. 5 is a schematic, overhead view of four types of samples a-d (see below) tested for adhesion.

In the following example, samples were prepared to demonstrate the improvement in adhesion when an embossed substrate or a substrate is modified to permit direct contact between the clearcoat and the laminate. A schematic, overhead view of the four types of samples a-d (see below) is shown in FIG. 5.

Example 1. 2"×3" (5 cm×7.5 cm) Ultem™ films were sanded with 320 grit sandpaper on both sides and adhered to steel test coupons with a 6 mil thick adhesive (Devcon HP250). Nominally 1"×1" (2.5 cm×2.5 cm) sections of the Ultem films were exposed to Corona pre-treatment then the surfaces were masked in a series of ways to allow for selective carbon nanotube application.
   a. Three control samples were not masked to allow for complete coverage of conductive coating onto the Ultem surface.
   b. Three samples were masked with ⅛" (0.3 cm) stripes (with ⅛" (0.3 cm) space between) to allow for approx 50% coverage of conductive coating onto the Ultem surface.
   c. Four samples were masked with 1/16" (0.16 cm) stripes (with 1/16" (0.16 cm) space between) to allow for approx 50% coverage of conductive coating onto the Ultem surface.
   d. Four samples of an embossed Ultem film as described in the "description" section of this document were also prepared. These samples were not masked.
2. A 6 mil (0.24 mm) wet coating of carbon nanotube dispersion was applied over the 1"×1" (2.5 cm×2.5 cm) section of Ultem™ film and dried for 3 hours in a 90° F. (32° C.) oven. The masks were then removed from the samples exposing specific areas of bare Ultem™ substrate. The carbon nanotube coating was removed from the tops of the peaks of the embossed samples d using a cotton swab lightly dampened with acetone.
3. A 2 mil (0.08 mm) wet 100% solids polyurethane coating was applied to the conductive areas. comprising:
   a. A 100% solids biobased polyol 2 grams
   b. A 100% solids isocyanate (Tolonate HDT-LV2™) 2.97 grams
   c. Dibutyl tin dilaurate catalyst 0.02 grams
4. The samples were cured for 2 hours at 90° F. (32° C.).
5. An aluminum pull-off button was glued to the center of each test area on top of the polyurethane coating using Scotchweld 1838 epoxy adhesive.
6. The samples were cured overnight in a 90° F. (32° C.) oven.
7. An Elcometer Model F106 pull off adhesion tester was used to measure the force required to pull of the aluminum button from each of the samples. The higher the value, the more force is required to remove the button and the better the adhesion of the coating.
8. The table below shows the results of the adhesion tests

| | Button | Force to Remove Button (psi) | Average Force (psi) |
|---|---|---|---|
| Sample a | 1 | 250 | 217 |
| | 2 | 200 | |
| | 3 | 200 | |
| Sample b | 1 | 325 | 308 |
| | 2 | 300 | |
| | 3 | 300 | |
| Sample c | 1 | 350 | 350 |
| | 2 | 400 | |
| | 3 | 350 | |
| | 4 | 300 | |
| Sample d | 1 | 300 | 281 |
| | 2 | 300 | |
| | 3 | 325 | |
| | 4 | 200 | |

The average adhesion force for samples with selective application of the carbon nanotube coating permitting the polyurethane coating to have direct contact with the Ultem substrate is higher than the control samples (a). This will be a great advantage to systems where adhesion between coating layers is a critical performance requirement.

Examples of Coating Performance in Simulated End-Application as Anti-icing and De-icing Resistive Heating on Leading Edge of Wing The following results are based on a resistive heater applied directly to a surface; however, it is believed that similar results would be obtained from a laminated resistive heater applied through a psa.

The Resistive Heating Coating (RHC) has successfully shown anti-icing/de-icing capability as integrated onto a full size wing at representative flight conditions and multiple test points between 0° F. and 28° F. (−18° C. and −2° C.).

To integrate the electrical leads to the RHC coating, flat braided copper power leads were fed through insulated holes and epoxied to wing surface. Power distribution is via alternating +/− leads to form one large parallel circuit. The size and geometry of each RHC "cell" is custom tailored for each application based on supply voltage, RHC thickness, etc. The RHC is then spray applied to wing and exposed leads creating one uniform conductive layer. After the RHC coating has cured the solventless polyurethane clear coating is sprayed applied to seal and protect the RHC and leads.

The carbon nanotube dispersion is applied over fully cured primer (either NCP 280 or Hysol E-60NC) which has been scuffed with a red Scotch Brite™ scouring pad. This ensures adhesion between the two coating layers. The best application was seen by using an artist's air brush. The air brush allows for very thin coating application and relatively minor overspray. Given the expense of carbon nanotubes, minimizing the overspray is important for cost effectiveness. If the carbon nanotube coating is applied in thick layers, it has a tendency to drip and pool into heavy build areas. These areas are lower in resistance and will result in "hot spots" on the part with uneven thermal distribution when a current is applied.

A typical 5"×5" (13 cm×13 cm) square area of resistive heating used 50 milliliters of carbon nanotube dispersion described below. In this example, approximately 30-35 coats were applied to a substrate heated to 120° F. (49° C.). The warm substrate accelerates the water evaporation of the dispersion.

The large wing section used for wind tunnel testing consisted of 8 5"×5" (13 cm×13 cm) squares and required 400 milliliters of CNT dispersion. The final resistivity ranged between 15-19 ohms per square.

The urethane topcoat consists of a 100% solids biobased polyol, an isocyanate hardener and dibutyl tin dilaurate catalyst. While solvents will disrupt the conductivity of the carbon nanotube coating, a 100% solids urethane coating will not cause any changes in conductivity of the CNT coating. For this effort, the polyol used was developed for low viscosity. It can be formulated with Tolonate HDT-LV2, a 100% solids Hexamethylene Diisocyanate hardener, but the cure time to final hardness is slow. These coatings were permitted to cure at room temperature, although a heat cycle will accelerate the cure.

When water or water-based coatings are applied onto a resistive heating carbon nanotube coating prepared from an aqueous dispersion the conductivity of the CNT networks is negatively influenced and the resistivity increases dramatically. If the CNT network were compromised by water from rain or ice formation on the surface of the wing, the resistive heating coating (RHC) would become inoperable. The 100% solids polyurethane protective coating prevented water from infiltrating into the CNT network and the heating performance was maintained throughout the wind tunnel tests.

During wind tunnel testing, first ice was accreted on the wing without activating the RHC system. Then the system was activated in de-icing and/or anti-icing operation modes. A majority of testing focused on determining anti-icing capabilities. As the testing progressed tunnel temperatures and Liquid Water Content (LWC) were adjusted to simulate continuous icing regimes at various RHC system power levels. Voltage was then increased to increase power densities to characterize operation of the technology.

A test matrix was developed in conjunction with AAI input to match FAA guidelines (FAA Part 25, Appendix C see US Federal Aviation Regulations, 14 C.F.R.). System level baseline concepts were implemented into the test sample. Testing was performed in a closed loop icing wind tunnel (Goodrich Icing Systems). Both anti-icing and de-icing tests were performed at voltages up 60 VDC & 7 Watts/in$^2$.

The wing was mounted vertically in the tunnel test section. The RHC coverage area on the wing was 5 inches× 40 inches (13 cm×101 cm). The test section offers optical access from cold room at left (top of wing), from control room at right (bottom of wing) and from top. 30 thermocouples were routed along bottom of test section. The wing Angle of Attack (AOA) was adjustable via indexed holes in the wing mounting plates.

The test matrix below illustrated the test conditions.

TABLE 1

Wind Tunnel Testing Conditions

| Angle of Attack (deg) | Velocity (MPH) | Tunnel Temp (F.) | Liquid Water Content (g/m^3)[1] | Water Spray Duration (mins) | Anti-Icing/ De-Icing[2] |
|---|---|---|---|---|---|
| 0 | 105 | 27 | 0.3 | 30 | Anti-Ice |
| 0 | 105 | 27 | 1.0 | 10 | Anti-Ice |
| 4 | 75 | 27 | 0.3 | 30 | Anti-Ice |
| 4 | 75 | 27 | 0.5 | 10 | Anti-Ice |
| 4 | 75 | 27 | 0.7 | 10 | Anti-Ice |
| 4 | 75 | 27 | 1.0 | 10 | Anti-Ice |
| 4 | 75 | 19 | 0.5 | 15 | Anti-Ice |
| 4 | 75 | 9 | 0.4 | 15 | Anti-Ice |
| 4 | 75 | 9 | 0.4 | 15 | Anti-Ice |
| 4 | 75 | 0 | 0.3 | 15 | Anti-Ice |
| 4 | 75 | 0 | 0.3 | 7.5 | Anti-Ice |
| 4 | 75 | 0 | 0.3 | 3 | Anti-Ice |
| 8 | 62 | 27 | 0.3 | 30 | Anti-Ice |
| 8 | 62 | 27 | 0.5 | 18 | Anti-Ice |
| 8 | 62 | 27 | 1.0 | 18 | Anti-Ice |
| 4 | 75 | 27 | 0.3 | 0 | De-Ice |
| 4 | 75 | 27 | 0.5 | 10 | De-Ice |
| 8 | 62 | 27 | 0.4 | 3 | De-Ice |
| 8 | 62 | 27 | 0.3 | 30 | De-Ice |

Notes:

[1]20 micron water droplet size for all conditions listed

[2]Anti-Icing = RHC system switched on prior to water spray, preventing buildup of ice layer. De-Icing = RHC activated after ice buildup Examples of particularly successful runs can be seen in run numbers 9, 20, and 24-30.

The testing shows that RHC has anti-ice/de-ice capability as integrated onto a full size wing at representative flight conditions. It has successfully demonstrated anti-icing/de-icing capability at multiple test points between 0° F. and 28° F. (−18° C. and −2° C.) using different LWC and droplet sizes. The operational envelop and power requirements were characterized. The higher the power density, the more severe the icing conditions can be tolerated. Additionally, increased power density offers better options for dealing with runback icing. The available power will influence final coating geometry and integration into an operational design. RHC is also an option for on-ground or on-launcher de-frost and anti-ice. The 100% solids polyurethane coating provided protection from the water droplets, ice formation and melting ice during all of the wind tunnel tests.

What is claimed:

1. A method of making a laminated resistive heater, comprising:

providing a polymeric base layer comprising peaks; forming a carbon nanotube (CNT) resistive heating layer having an interior that is substantially polymer-free disposed on the surface of the polymeric base film resistive heating layer, providing first and second electrical leads connected to the CNT layer; providing a protective polymer layer disposed on a side of the CNT layer opposite the side facing the base layer, wherein the protective layer adheres to the base film at the peaks on the polymeric base layer; and wherein the CNT layer has a thickness in the range from 0.05 μm to 100 μm.

2. A laminated resistive heater made by the method of claim 1.

3. The method of claim 1 further comprising a step of applying a pressure sensitive adhesive (psa) disposed on a side of the polymeric base layer opposite the side on which the CNT layer is disposed.

4. The method of claim 1 wherein the step of forming a carbon nanotube (CNT) resistive heating layer comprises applying a carbon nanotube (CNT) dispersion onto the surface of the polymeric base layer.

5. The method of claim 1 wherein the polymeric base layer is an embossed layer.

6. The method of claim 1 wherein the peaks are wiped clean prior to applying the protective polymer layer.

7. The method of claim 1 wherein the first and second electrical leads are applied after the CNT layer has been applied.

8. The method of claim 1 wherein the CNT layer has an interior that comprises 5 wt % or less of polymer.

9. A method of making a laminated resistive heater, comprising:

providing a polymeric base layer comprising peaks; forming a carbon nanotube (CNT) resistive heating layer having an interior that is substantially polymer-free disposed on the surface of the polymeric base film resistive heating layer, providing first and second electrical leads connected to the CNT layer; providing a protective polymer layer disposed on a side of the CNT layer opposite the side facing the base layer, wherein the protective layer adheres to the base film at the peaks on the polymeric base layer;

wherein the step of forming a carbon nanotube (CNT) resistive heating layer comprises applying a carbon nanotube (CNT) dispersion onto the surface of the polymeric base layer; and wherein the CNT dispersion is applied by a coating method selected from the group consisting of: spraying, roll-coating, gravure printing, flexography, brush application, and spin-coating.

10. The method of claim 9 wherein the CNT layer has a thickness in the range from 0.05 μm to 100 μm.

11. The method of claim 1 wherein the protective polymeric layer has a thickness of 250 nm to 50 μm.

12. The method of claim 1 wherein the application of the protective polymeric layer results in less than a 10% change in resistance.

13. The method of claim 4 wherein the polymeric base layer is treated, prior to applying the CNT dispersion, with a treatment selected from the group consisting of: corona treatment, plasma treatment, and gas flame treatment.

14. The method of claim 4 wherein the polymeric base layer is corona treated prior to applying the CNT dispersion.

15. The method of claim 14 wherein the polymeric base layer is sanded prior to being corona treated.

* * * * *